US010100523B1

(12) United States Patent
Brookheart

(10) Patent No.: US 10,100,523 B1
(45) Date of Patent: Oct. 16, 2018

(54) VENT ASSISTED SINGLE PLY ROOF SYSTEM

(71) Applicant: Brian E. Brookheart, Olney, IL (US)

(72) Inventor: Brian E. Brookheart, Olney, IL (US)

(73) Assignee: VADA, LLC, Olney, IL (US)

( * ) Notice: Subject to any disclaimer, the term of this patent is extended or adjusted under 35 U.S.C. 154(b) by 0 days.

(21) Appl. No.: 15/242,700

(22) Filed: Aug. 22, 2016

Related U.S. Application Data

(63) Continuation-in-part of application No. 14/847,177, filed on Sep. 8, 2015, now Pat. No. 9,422,725.

(60) Provisional application No. 62/046,266, filed on Sep. 5, 2014.

(51) Int. Cl.

| | |
|---|---|
| ***E04B 1/00*** | (2006.01) |
| ***E04D 13/17*** | (2006.01) |
| ***E04D 11/02*** | (2006.01) |
| ***E04H 9/14*** | (2006.01) |
| ***E04D 5/14*** | (2006.01) |
| ***F24F 7/02*** | (2006.01) |

(52) U.S. Cl.
CPC ..... *E04D 13/172* (2013.01); *E04D 5/146* (2013.01); *E04D 5/148* (2013.01); *E04D 11/02* (2013.01); *E04H 9/14* (2013.01); *F24F 7/025* (2013.01)

(58) Field of Classification Search
CPC ..... E04D 3/17; E04D 3/172; E04D 11/02; E04D 3/38; E04D 5/141; E04D 5/142; E04D 5/143; E04D 5/144; E04D 5/148; E04D 5/146; F24F 7/025; E04H 9/14
USPC ..... 52/509, 410, 746.11, 94, 96, 97, 199, 52/408, 506.01, 506.04, 506.1
See application file for complete search history.

(56) References Cited

U.S. PATENT DOCUMENTS

| | | | |
|---|---|---|---|
| 700,126 | A | 5/1902 | Kintner |
| 3,680,269 | A | 8/1972 | Lang |
| 3,862,527 | A | 1/1975 | Peterson et al. |
| 4,161,854 | A | 7/1979 | Stelzer |
| 4,192,116 | A | 3/1980 | Kelly |
| 4,223,486 | A | 9/1980 | Kelly |
| 4,441,295 | A | 4/1984 | Kelly |
| 4,506,483 | A | 3/1985 | Phalen |
| 4,557,081 | A | 12/1985 | Kelly |
| 4,574,544 | A | 3/1986 | Harris |
| 4,588,458 | A | 5/1986 | Previsani |
| 4,608,792 | A | 9/1986 | Gerber |
| 4,619,100 | A | 10/1986 | Emblin |
| 4,649,686 | A | 3/1987 | Backenstow et al. |
| 4,688,361 | A | 8/1987 | Kelly |
| 4,736,562 | A | 4/1988 | Kelly |
| 4,741,132 | A | 5/1988 | Emblin |
| RE32,710 | E | 7/1988 | Seaman |
| 4,860,514 | A | 8/1989 | Kelly |
| 4,864,781 | A | 9/1989 | Emblin |
| 4,888,930 | A | 12/1989 | Kelly |

(Continued)

*Primary Examiner* — Chi Q Nguyen
(74) *Attorney, Agent, or Firm* — Grace J. Fishel

(57) ABSTRACT

A vent assisted system for reroofing a built up roof surface or a single ply membrane roof covering including an augmented design incorporating mechanical fasteners and an adhesive for attaching strips of single ply membrane or fleece backed single ply membrane in the turbulent vortex areas along the perimeter of a deck. Coupled with roof vents for equalizing the pressure under loose laid sheets of single ply membrane or fleece backed single ply membrane in the field-of-roof area bordering the turbulent wind vortex areas to reduce membrane stress and resist wind uplift pressures during high wind events.

5 Claims, 3 Drawing Sheets

(56) References Cited

U.S. PATENT DOCUMENTS

| | | | |
|---|---|---|---|
| 4,965,977 | A | 10/1990 | White |
| 5,213,542 | A | 5/1993 | Kelly |
| 5,251,416 | A | 10/1993 | White |
| 5,740,647 | A | 4/1998 | Kelly |
| 5,800,891 | A | 9/1998 | Wasitis |
| 6,092,344 | A | 7/2000 | Kelly |
| 6,108,993 | A | 8/2000 | Hageman |
| 7,001,266 | B2 | 2/2006 | Jones |
| 2004/0003563 | A1 | 1/2004 | Burdic |
| 2007/0281119 | A1 | 12/2007 | Di Stefano et al. |
| 2009/0229204 | A1 | 9/2009 | Kassem |
| 2009/0255201 | A1 | 10/2009 | Kraus, Jr. |
| 2010/0088974 | A1 | 4/2010 | Scott |
| 2014/0075980 | A1 | 3/2014 | Villar |
| 2014/0260036 | A1 | 9/2014 | Freeman |
| 2016/0024795 | A1 | 1/2016 | Freeman |

VENT ASSISTED SINGLE PLY ROOF SYSTEM

BACKGROUND OF THE INVENTION

This application is a continuation-in-part of U.S. application Ser. No. 14/847,177, filed Sep. 8, 2015, for Vent Assisted Single Ply Roof System.

BACKGROUND OF THE INVENTION

1. Field of the Invention

The present invention relates to a vent assisted design assembly for recovering an existing roof surface with a single ply membrane with increased wind resistance using active roof vents and augmented perimeter attachment.

2. Brief Description of the Prior Art

Single-ply roofing systems using EPDM (ethylene propylene diene) rubber, chorosulphanated polyethylene, TPO (thermoplastic polyolefin), PVC (polyvinylchloride), and other synthetic single layer sheets as the top layer of water impervious material are especially advantageous for flat or low pitch roofs, such as found on large commercial buildings. When wind rolls over the edges of a roof, a vortex is created which is most intense along perimeter edges and particularly at corners. This vortex creates an uplift pressure which can cause a single-ply membrane to peel starting in the turbulent wind vortex areas of the perimeter edges. In the field-of-roof area inside the corners and perimeter, wind uplift is diminished.

All single-ply roofing systems have two main challenges: Making seams via heat welding, adhesives, caulks and tapes; and, Designing a system that keeps the membrane on the roof in high wind. Everything done on a roof project is related to those two tasks, with most of the engineering and design being spent on the latter.

There are a number of techniques used to keep membranes on top of the roof. These include: (1) Stone Ballast—inexpensive but the weight added to the building is a concern; (2) Fully Adhered, i.e. gluing the membrane to the substrate using adhesives—expensive and there is growing concern over volatile organic compounds (VOCs) contained in the glue being released into the environment; (3) Mechanically Fastened—inexpensive, lightweight, lower VOC's but trapping moisture under the membrane and flutter fatigues are concerns and (4) Vented devices to equalize wind uplift pressure.

The Thomas L. Kelly, Roof Equalizer patent (U.S. Pat. No. 4,223,486) laid the foundation for using roof vents to equalize wind uplift. The patented vent was commercialized by the 2001 Company but the balance of the Kelly roof system was flawed. In the 2001 Company systems the membranes are mechanically fastened at the roof edge and glued for 24 or 30 inches at the corners and along the perimeter edges. Although the patented roof reduces wind uplift pressure, the corners and perimeter of the membrane tend to begin to flutter as a first stage of peeling as membranes shift and adhesives dry out which can result in catastrophic roof failure. Most of the engineering and design effort in the single-ply roof industry after Thomas L. Kelly's passive vent has been focused on differing vent designs such as turbine vent systems like those made by Burke Industries or Venturi vents licensed by Virginia Tech Intellectual Properties, Inc. Neither of which have addressed the need for increased perimeter attachment or for identifying the most effective location for the vent.

BRIEF SUMMARY OF THE INVENTION

In view of the above, it is an object of the present invention to provide a vent assisted single-ply roof system with increased wind resistance for use in recovering a roof. Other objects and features of the invention will be in part apparent and in part pointed out hereinafter.

The present invention relates generally to a vent assisted design that uses augmented perimeters in conjunction with turbine roof vents to provide resistance to wind uplift pressures during high wind events. The design incorporates ASCE 7 identified turbulent wind vortex areas with a vent assisted field-of-roof area for maximum wind uplift resistance over the life of the roofing system.

In an aspect of the invention, a perimeter augmented design incorporates mechanical fasteners, low-rise foam adhesives and membrane bonding adhesives in combinations that surpass wind uplift requirements of a given building perimeter ensuring that the roof performs in high wind uplift conditions. The combination of mechanical fasteners, low-rise foam adhesives and membrane bonding adhesives reduces damage in the turbulent wind vortex areas of the deck.

With the perimeter adequately protected against wind uplift in the turbulent wind vortex areas, the balance of the roof is protected against wind uplift using turbine roof vents. In an embodiment, the turbine roof ventilators are distributed in the interior of the field-of-roof area at a rate of one per 6,000 square feet, minimum. In some embodiments, a vacuum distribution membrane comprising a porous plastic mesh is installed between the ventilators. Wind blowing over the roof surfaces causes the turbine to spin, creating a vacuum, holding the roof membrane in place.

The invention summarized above comprises the methods and constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific methods and constructions illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
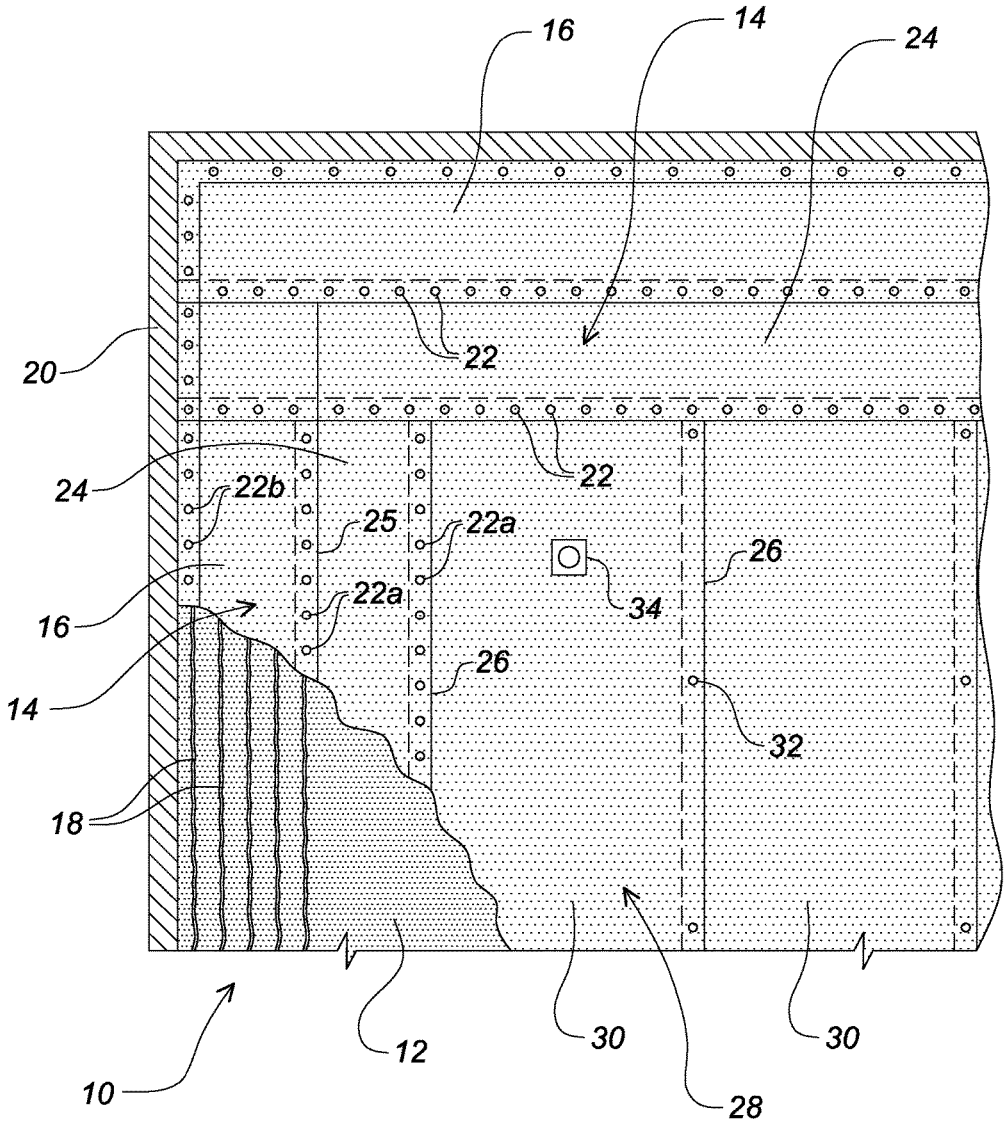
FIG. 1 is a diagram illustrating a roof deck with a built up roof surface to which a fleece backed single ply membrane is adhesively secured with low-rise foam adhesive and mechanically fastened in the turbulent wind vortex areas and with fleece backed membrane loose laid and tacked where necessary until welded, taped or glued together in the field-of-roof area.

Referring to the drawings more particularly by reference character, as shown in FIG. 1 a deck 10 with an existing built up roof surface 12 is recovered with a fleece backed single ply membrane. Built up roof surface (BUR) 12 is formed from alternating layers of bitumen or cold applied adhesive and reinforcing fabrics finished with glass-fiber or mineral surfaces, hot asphalt mopped, aluminum coatings, elastomer coatings and the like. Before beginning recovering, deck 10 should be inspected to determine that it is structurally sound and capable of holding mechanical fasteners that are installed in a turbulent wind vortex area 14. Commercially available fleece backed single ply membranes have a synthetic rubber sheet (such as TPO, EPDM, PVC or the like) with a non-woven polyester or polyolefin textile matting.

As a first step, the turbulent the wind vortex area 14 of deck 10 is determined by using ASCE 7 wind uplift calculations based data gathered about the building and the surrounding geography such as the building's overall height, the terrain surrounding the structure, whether or not the building has parapet walls, and if it does, their height, etc. The roof perimeter and corners are exposed to higher uplift forces than the field-of-roof. The maximum uplift forces occurs at the corners when the wind blows at an angle of about 45 degrees to the roof (i.e., roughly along the diagonal). The maximum uplift force along the windward roof perimeter occurs when the wind blows at 90 degrees to the perimeter. As mentioned above, actual pressure coefficients at the corners and perimeter vary depending on the deck height, parapet height, roof slope, etc.

An earlier version of ASCE 7 (ASCE 7-05) used a single basic wind speed map. For each building risk category, an importance factor and a wind-load factor determine ultimate wind loads. The newer version of ASCE 7 (ASCE 7-10) uses building occupancies. Based on ASCE 7 calculations, a rule-of-thumb has been developed to determine the width of the turbulent wind vortex areas 14. Using that rule-of-thumb method, the width of turbulent wind vortex areas 14 may be determined by using ten percent of a shortest side of the deck 10 or 40 percent of the height of the deck 10 but using never less than 5 feet as the width of the turbulent wind vortex areas 14.

A low-rise foam adhesive is selected for use in the turbulent wind vortex areas 14. There are one-component and two-component low-rise polyurethane adhesives. One-component adhesives are "moisture cured" and two-component adhesives are "chemically cured." A consultation with the adhesive manufacturer for substrate compatibility of the built up roof surface 12 with the low-rise foam adhesive may be desirable. One-component formulations typically take longer to foam and expand less than two-component formulations. Two-component formulations cover a relatively larger surface area, cure more rapidly and are usually preferred.

Consultation with the adhesive manufacturer may also be desirable to determine the correct steps for surface preparation. Typical manufacturer recommendations include removing contaminants and loose material by sweeping, vacuuming or power washing. The low-rise foam adhesive is applied to the substrate as a bead. Recommendations for the width and spacing of the beads from different manufacturers may also vary. Most frequently a spacing of 12 inches on center is recommended but in corner roof areas spacing may range from 4 to 6 inches. The width and thickness of the bead is also influenced by the texture of built up roof surface 12. Installation instructions for two-component low-rise foam adhesives typically call for placement of the fleece backed single ply membrane over the substrate immediately after the beads are applied. The membrane then rolled so that the low-rise foam adhesive is uniformly spread.

Fleece backed single ply membrane typically comes in 10' and 12' sheets. To create a narrow strip 16 of fleece backed single ply membrane in turbulent wind vortex area 14 as shown in FIG. 1, a sheet of fleece backed single ply membrane is laid with the outboard side aligned with an edge of the roof or parapet 20. A row of mechanical fasteners 22*a* is installed inboard about 5' and parallel to the edge of roof or parapet 20. The outboard side of the sheet is folded back to the line of mechanical fasteners 22*a*. Beads 18 of low-rise foam adhesive are applied to the built up roof surface 12 from fasteners 22*a* to the edge of roof or parapet 20. The folded strip 16 is turned over the beads 18, rolled and another row of mechanical fasteners 22*b* is installed along the roof edge or parapet 20 thus creating the attachment of narrow strip 16. A tape 25 may be applied over fasteners 22*a*. Depending on the width of turbulent wind vortex area 14, the unattached side of the sheet may be glued down and a row of mechanical fasteners 22*a* installed parallel with the previous two to create a second strip 24. The process is repeated with the outboard side of the next sheet overlapping row of mechanical fasteners 22*a* on second or last strip 24 until all of the perimeter strips have been installed. The inboard side of a sheet not needed as a strip in the turbulent wind vortex area 14 is not glued down and becomes part of the field-of-roof area 28 as described below.

The field-of-roof area 28 of the built up roof surface 12 inside the turbulent wind vortex areas 14 is finished with fleece backed single ply membrane sheets 30 loose laid over the built up roof surface 12. A row of mechanical fasteners 22*a* is provided at the transition between the turbulent wind vortex areas 14 and the field-of-roof area 28 to prevent any flutter coming into the turbulent wind vortex areas 14 originating in the field-of-roof area 28. The loose sheets 30 in the field-of-roof area 28 may be tacked 32 during installation to hold them in place until the seams 26 between the sheets are heat or glue sealed or taped.

A roof vent does not create enough vacuum to overcome the turbulent uplift vortex in a roof's turbulent wind vortex areas 14 and is not needed because of the narrow strips 16, 24 and rows of fasteners 22 on both sides of the strips. In the field-of-roof area 28 out of the turbulent wind vortex areas 14, vacuum-producing roof vents 34 are effective at counteracting wind uplift on the membrane. Updated versions of "whirlybird" turbine vents are preferred as described below over the equalizer vents sold by the 2001 Company or those sold under the trademark V2T.

Placement of the vents 34 (whether whirlybird style or otherwise) may be empirically determined where the wind flow is highest inside the field-of-roof area by observations made on the roof. But as a rule-of-thumb, vents 34 may be effectively placed 24 inches from the turbulent wind vortex areas 14, i.e., 24 inches from the perimeter along the edge of the deck and 24 by 24 inches from the corners. Vents 34 may be spaced farther from the turbulent wind vortex areas 14 but preferably not much closer.

Figure 2:
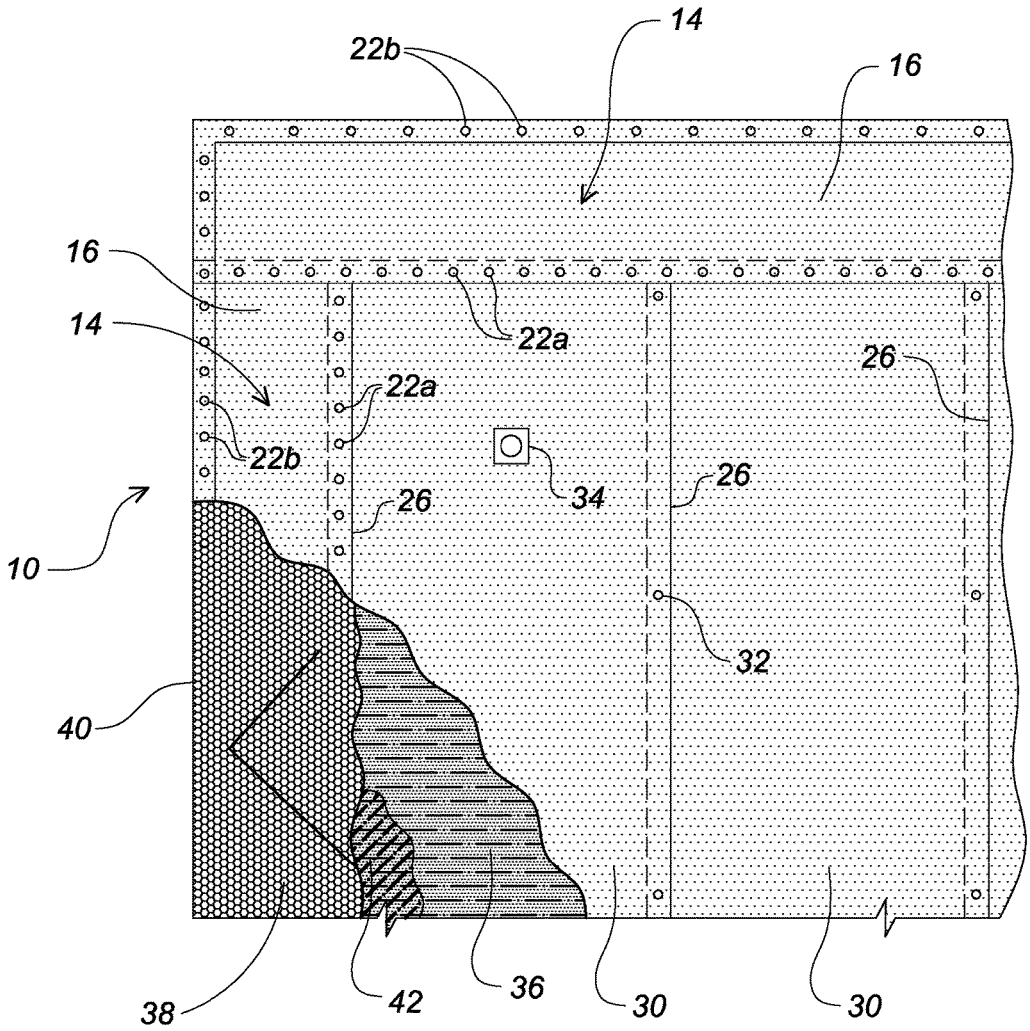
FIG. 2 is a diagram illustrating a roof deck covered with a single ply membrane to which single ply membrane is adhesively secured with cold applied adhesive and mechanically fastened in the turbulent wind vortex areas and with single ply membrane loose laid and tacked where necessary until welded, taped or glued together in the field-of-roof area; and, FIG. 3 is a diagram showing the turbulent wind vortex areas around the perimeter of a roof and a field-of-roof area inside the turbulent wind vortex areas in which vents are installed for equalizing the pressure under the loose laid membrane.
Figure 3:
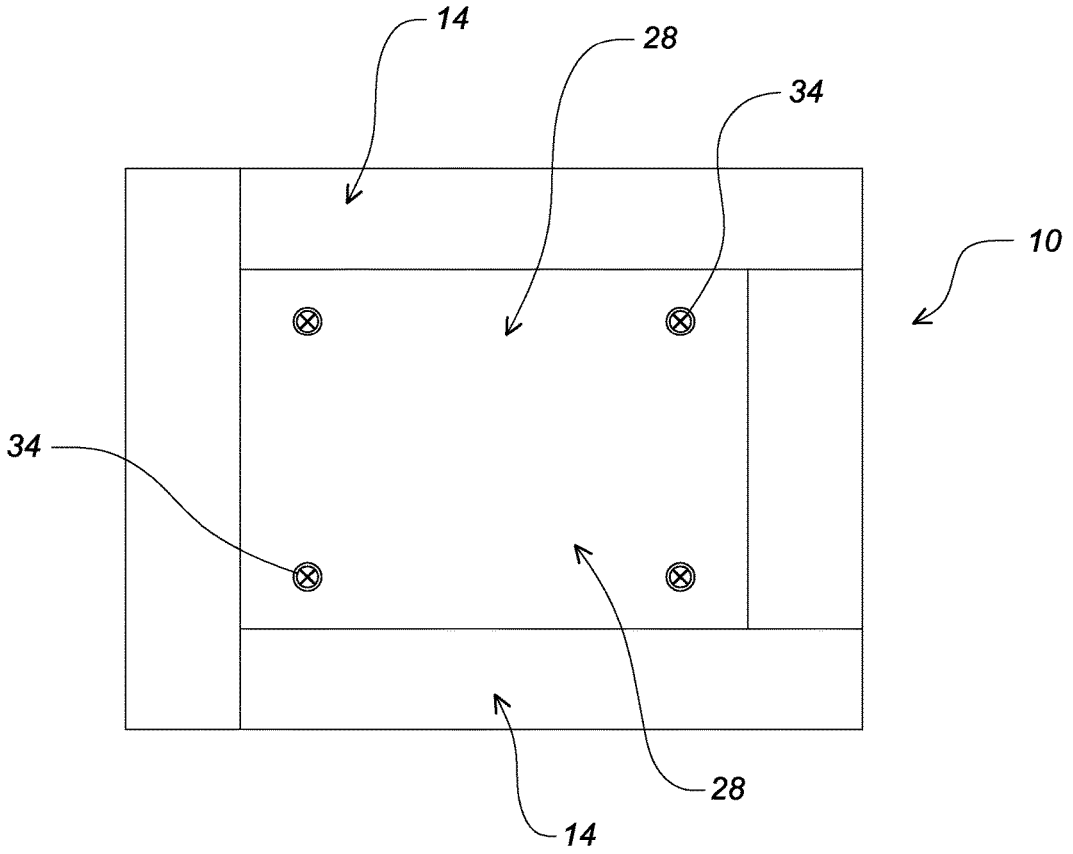

Turning to FIG. 2, a deck 10 with an existing single ply membrane roof covering 36 is recovered with a single ply membrane. The procedure is similar to that described above except that strips 14, 24 may be formed with 5' sheets of single ply membrane from the manufacturer or by cutting wider sheets in half and a cold applied adhesive 38 is used instead of a low-rise foam adhesive. Also as illustrated in FIG. 2, a row of mechanical fasteners **22*b* is provided along the first side of first strip 16 at the roof edge 40. In addition a slip sheet or mat 42 may be provided between single ply membrane roof covering 36 and the single ply membrane used for reroofing. On occasion, there are incompatible chemical compounds in the existing single ply membrane and the new single ply membrane such as between TPO and PVC and a protective layer may be used. Slip sheets or mats 42** may be made of polyester fabric, polyethylene plastic, fiberglass fabric, polyester mesh, fiberglass mesh and so forth.

As seen from the above, the attachment along the perimeter in the turbulent wind vortex areas 14 is "over designed" but roofs blow off from the perimeter in. In the field-of-roof area 28 vents 34 are installed. The combination of augmented, redundant perimeters paired with superior turbine vents as described above produces a vented roof covering with increased wind resistance that can be installed over an existing built up roof surface or single ply membrane roof covering.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. Hence as various changes could be made in the above constructions without departing from the scope of the invention, it is intended that all matter contained in the above description or shown in the accompanying drawings shall be interpreted as illustrative and not in a limiting sense.

What is claimed:

1. A ballast free method for improving single ply roof performance in wind conditions on a roof having a substantially flat deck with an existing single ply membrane roof covering, said deck having turbulent wind vortex areas and a field-of-roof area outside the turbulent wind vortex areas, said turbulent wind vortex areas having a higher wind load than the field-of roof area, comprising:

determining the turbulent wind vortex areas of the substantially flat deck, gluing and mechanically fastening one or more strips of a single ply membrane to said existing single ply membrane roof covering over the entire turbulent wind vortex areas, each single ply membrane strip having a row of fasteners along a first side at a roof edge, a parapet or bordering another strip and a row of mechanical fasteners along a second side;

loose laying and seaming together single ply membrane sheets over the entirely of the existing single ply membrane roof covering in the field-of-roof area, said strips of single ply roofing membrane in the turbulent wind vortex areas having a row of mechanical fasteners on a transition between the turbulent wind vortex areas and single ply membrane sheets in the field-of-roof area; and, installing at least one vent only in the field-of-roof area outside of the turbulent wind vortex areas.

2. The method of claim 1 wherein the at least one vent is a turbine vent.

3. The method of claim 1 wherein the strips in the turbulent wind vortex areas are glued with a cold applied adhesive.

4. The method of claim 1 wherein the spacing between the mechanical fasteners is a maximum of 12 inches on center.

5. The method of claim 1 wherein a slip sheet or mat is installed over the existing single ply membrane before the one or strips of a single ply membrane are glued and mechanically fastened in the turbulent wind vortex areas and the single ply membrane sheets are loose laid and seamed together in the field-of-roof area.

* * * * *